United States Patent [19]

Steinmetz

[11] 4,331,878

[45] May 25, 1982

[54] INFRARED RADIATION SYSTEM

[76] Inventor: Manfried Steinmetz, Stettiner Strasse 14, 3410 Northeim, Fed. Rep. of Germany

[21] Appl. No.: 141,106

[22] Filed: Apr. 17, 1980

[30] Foreign Application Priority Data

May 17, 1979 [DE] Fed. Rep. of Germany ..... 2919964

[51] Int. Cl.[3] ..... G21F 5/00

[52] U.S. Cl. ..... 250/504 R; 250/495; 219/345; 219/354

[58] Field of Search ..... 250/341, 493, 504, 495; 219/553, 342, 343, 347, 354, 355, 460, 461

[56] References Cited

U.S. PATENT DOCUMENTS

| | | | |
|---|---|---|---|
| 1,514,628 | 11/1924 | Pritzker | 219/461 |
| 3,008,030 | 11/1961 | Stanford et al. | 219/347 |
| 3,141,089 | 7/1964 | Hultgreen | 219/354 |
| 3,612,829 | 10/1971 | Evans | 219/461 |
| 3,688,084 | 8/1972 | Charneski | 219/347 |
| 3,749,883 | 7/1973 | Vodvarka | 219/460 |
| 3,761,678 | 9/1973 | Eckles | 250/495 |
| 4,243,874 | 1/1981 | Fischer | 219/355 |

*Primary Examiner*—Harold A. Dixon
*Attorney, Agent, or Firm*—Max Fogiel

[57] ABSTRACT

An infrared radiation radiating system has a plurality of hollow infrared radiator casings mounted on and projecting forwardly or downwardly from a support. Each casing has a front portion in which a ceramic radiating element is mounted, and a tubular rear portion extending back from the front portion and being connected to the support. Thermally insulating material fills all or part of the front and rear portions of the casings as well as the space between the front portions and the support.

11 Claims, 4 Drawing Figures

INFRARED RADIATION SYSTEM

BACKGROUND OF THE INVENTION

This invention relates to an infrared radiation system, and more particularly to an infrared radiation system of the type having a plurality of infrared radiators—preferably of the ceramic type—with heat-loss prevention.

Ceramic infrared radiators are already known having a casing which, at the side where the heat is radiated, is essentially planar whereas the rear side carries a mounting socket projecting in rearward direction. The casing is hollow. This type of radiator has the disadvantage that its mounting, which ultimately means the carrier or housing to which the hollow socket is connected, and the space located between the mounting and the front part of the radiator which carries the radiating element, becomes very strongly heated in operation of the unit. This results in heat losses and presents problems in terms of installation because of possible fire hazards. Moreover, due to convection and the settling of dust and dirt on the radiators during operation of the system, additional very significant heat losses result which leads to an increased use of energy and to a reduced heating efficiency of the system.

SUMMARY OF THE INVENTION

It is, accordingly, a general object of the invention to overcome these prior-art disadvantages.

A more particular object of the invention is to provide an improved infrared radiating system (a term which applies both to the individual radiators and to a plurality of such radiators installed in or on a carrier) which overcomes the aforementioned disadvantages and provides a substantially uniform surface temperature of the radiating surface while at the same time minimizing or avoiding heat losses, particularly those in direction rearwardly towards the carrier and the wiring space.

Still a further object of the invention is to provide such an improved radiating system in which a substantial reduction in the amount of energy required for its operation, is obtained.

Pursuant to the above objects, and still others which will become apparent hereafter, one object of the invention resides in an infrared radiating system which, briefly stated, comprises a support, a plurality of hollow infrared radiators each including a front portion having a radiating element and a rear portion mounted to the support, and thermally insulating means rearwardly of the radiating elements and filling at least one of the spaces between the radiators and the support and the hollow interiors of at least the front portions of the radiators.

It is preferable that both the spaces between the radiators and the support and also the hollow interiors of the front portions and the rear portions be filled with thermally insulating means, i.e. a suitable thermally insulating material well known in the art.

It is a further advantage for the rear portion or mounting socket to have such a substantial height—i.e. greater than known from the prior art—that, together with the presence of the thermally insulating material the transmission of heat to the support—which may be the rear wall of the housing—is eliminated or at least reduced to a minimum.

The rear surfaces of the front portions of the radiators may be provided with a heat reflecting layer, particularly a shiny (bright) metal foil, for which an aluminum foil has been found to be particularly advantageous. Such a reflection foil may be located between the rear faces of the front portions of the radiators and the thermally insulating material which is located behind these front portions. This not only improves the radiation of heat forwardly, i.e. where the heat is bonded, but also at the same time reduces the transmission of heat in rearward direction and prevents—for example in the event of inadvertent vibrations or the like which are transmitted to the system—that thermally insulating material may fall out through the gaps between the individual radiators of the system. The radiating elements themselves are preferably of right-angular (i.e. quadratic or rectangular) outline and the radiating elements of all of the radiators on a common carrier or housing together from a radiating surface which is essentially planar, the free space between the rear side of the radiators and the mounting plane being provided with the thermally insulating means.

By providing the radiators with rear portions of greater than usual height (i.e. length) sufficient space exists behind the front portions so that a thermally insulating layer of requisite thickness can be installed which prevents or at least minimizes the transmission of heat to the support, e.g. a rear wall of a housing.

The layer of thermally insulating material may also be mated with a layer of heat reflecting material, such as bright metallic foil, so as to form a composite pad. The heat reflecting material should preferably extend in particular over the gaps between the individual radiators so as to prevent portions of the thermally insulating material from dropping out through these gaps. The rear portions or mounting sockets of the radiators then simply extend through this pad and are connected to the support in the usual manner. In addition to this measure or in place of it, the gaps between the adjacent radiators may be covered with separate cover material which prevents dropping-out of the thermally insulating material.

Due to the construction of the radiators in the manner according to the invention, and their arrangement to form an overall radiating system, a substantial reduction in the required amount of energy is effected. Furthermore, the radiators themselves are protected to a large extent against damage or interference resulting from vibrations. Moreover, since the invention drastically reduces the temperature which in operation of the system prevails in the wiring space, i.e. the space rearwardly of the radiating elements and forwardly of the support on which the radiators are mounted, the wiring is simplified and less expensive wiring can be utilized (e.g. wiring which does not have high temperature insulation).

The invention will hereafter be described with reference to an exemplary embodiment. It is to be understood, however, that this is for purposes of explanations only and is not to be considered limiting.

DESCRIPTION OF PREFERRED EMBODIMENTS

Figure 1:
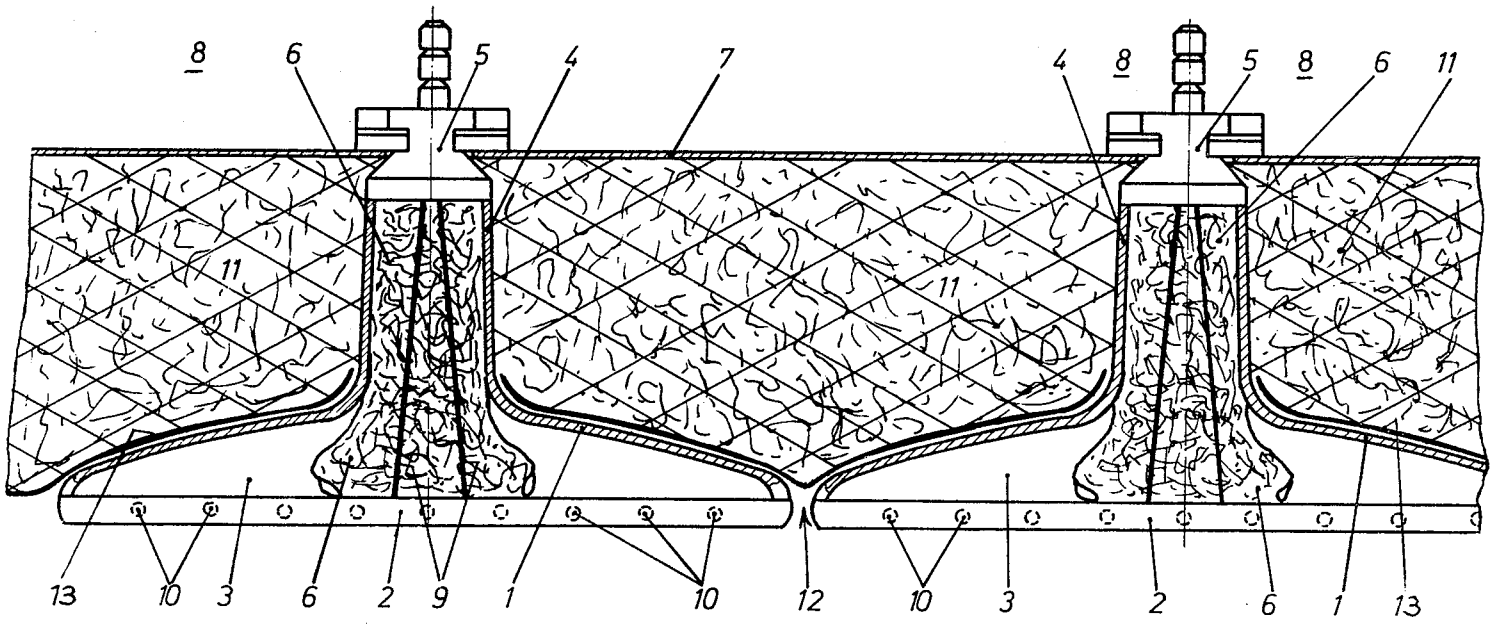
FIG. 1 is a fragmentary vertical section through a radiating system embodying the invention.
Figure 2:
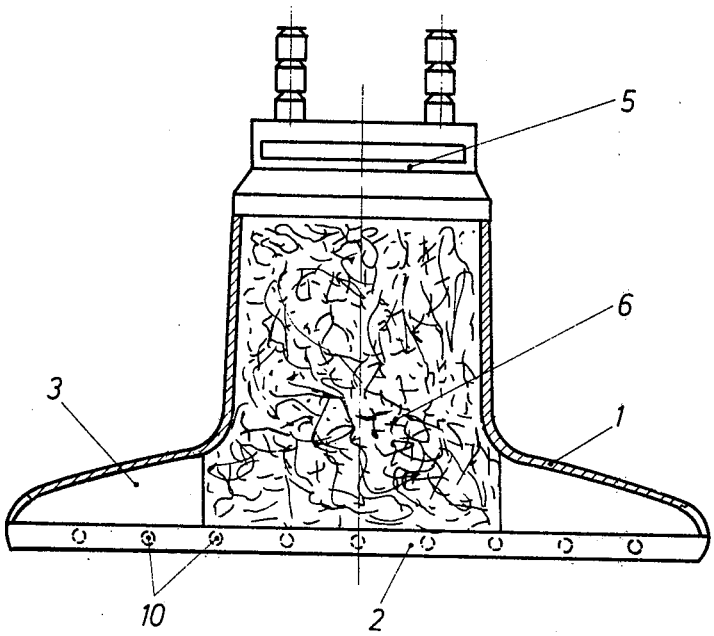
FIG. 2 is a vertical section through a radiator of the type used in FIG. 1, taken on a plane extending normal to the plane of FIG. 1.
Figure 3:
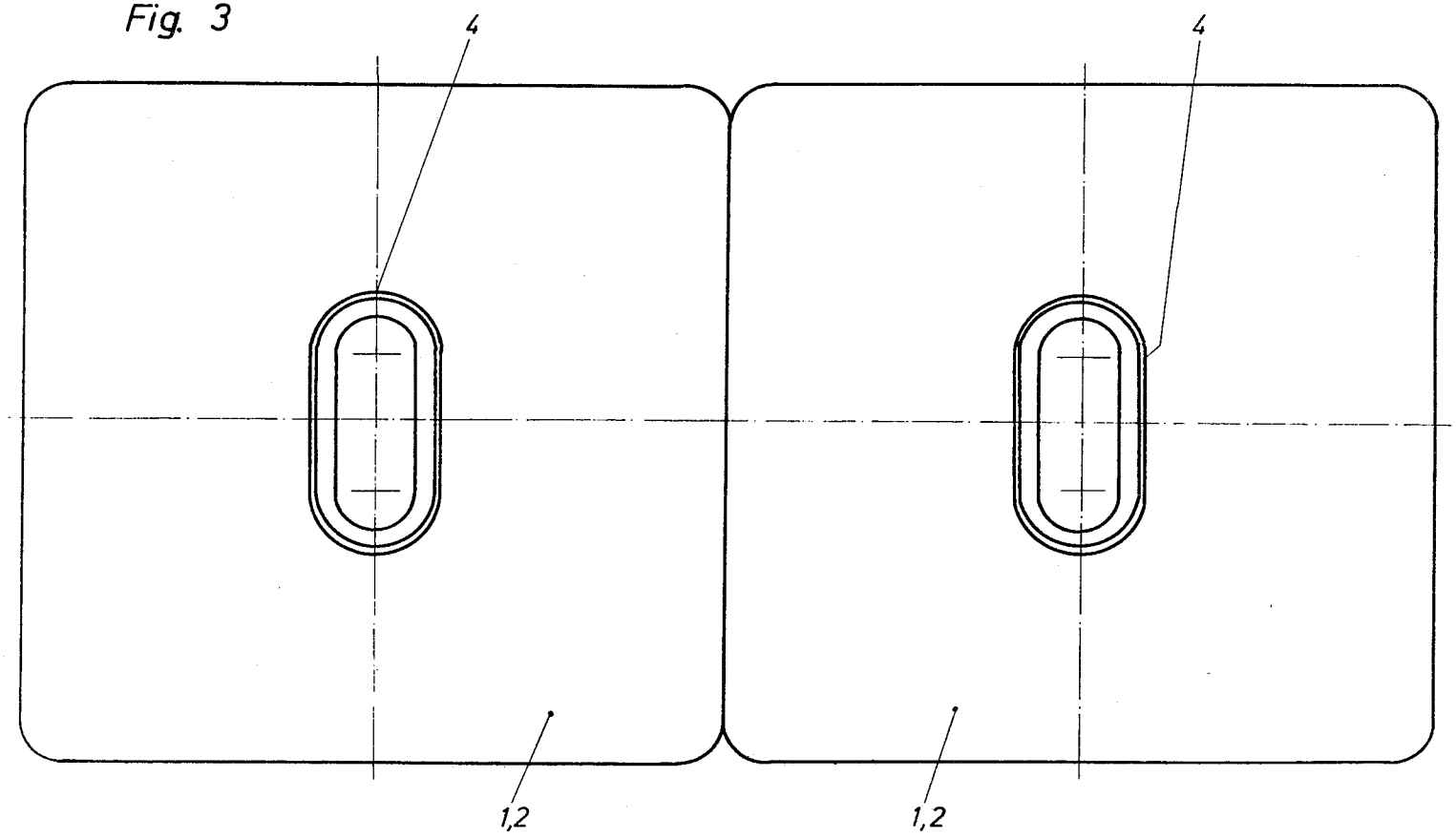
FIG. 3 is a top-plan view of FIG. 1.

Referring firstly to the embodiment in FIGS. 1–3 it will be seen that an infrared radiator according to the invention has a quadratic or rectangular infrared radiating element forming at its normally downwardly facing side (these units are usually mounted overhead) a substantially planar radiating surface 2 in which electrical resistance wires 10 are embedded. The radiating element having the surface 2 is of ceramic material in a manner known from the prior art and therefore not requiring discussion. The radiator 1 has a hollow casing, i.e. a hollow space for interior 3 exists between the surface 2 and the rearwardly directed surface of the front portion of the casing 1, i.e the surface which faces towards the carrier or mounting wall 7. Extending rearwardly from the front portion is a mounting socket or rear portion 4 which is also hollow and which carries at its upper side the mounting elements 5 (compare FIGS. 2 and 3 with FIG. 1). The current conductors 9 extend through the socket 4 and are connected in a manner known from the prior art and requiring no description to the electrical resistance wires 10. The hollow space 3 is at least in part and the socket 4 is preferably completely filled with a thermally insulating material 6, such as one of the various materials which are known from the prior art for this purpose. Of course, the entire space 3 can be filled with this material if desired. The radiators 1 are mounted on a carrier which may be the rear wall 7 of a housing from the open front side of which the devices radiate heat; mounting is effected in known manner by means of known clamping devices or the like; or in fact any desired and suitable way, but preferably that the individual radiators 1 can each be readily removed for inspection and/or replacement. Above the carrier 7, through which the mounting elements of the radiators 1 extend, there is the wiring space 8 in which the current connections and current conductors (not shown) are located.

The space 11 located between the wall or carrier 7 and the rearwardly directed surfaces of the front portion of the housing 1 is preferably also completely filled with the thermally insulating material 6. In addition, a heat reflecting foil 13 of bright metallic material, for example a foil of aluminum, is interposed between the material 6 and the rearwardly directed surfaces of the front portion of the radiator casings 1. If, as in the illustrated embodiment, the system is composed of a plurality of the radiators 1, then the foil 13 also covers the gaps which remain between adjacent ones of the radiators 1 so that in the event of vibrations or the like the thermally insulating material 6 cannot drop out of the space 11 through these gaps 12 (compare FIG. 1). In addition, of course, and as its promary function the foil 13 reflects the heat forwardly to the area to be heated instead of allowing it to pass unhindered into the space 11.

An important aspect of the invention is that in each of the radiators 1 the mounting portion or socket 4 is higher (longer) than this is known and customary in the case of prior-art ceramic infrared radiators. The purpose of this is to permit the depth of the space 11 (and thus the thickness of the layer of insulating material 6 which can be accommodated therein) to be so substantial that as a function of the thickness of this layer of insulating material 6 and the heat reflecting capability of the metal foil 13, a pad or bed is created for the individual radiators whose sockets 4 extend through holes in this pad. Due to the tight reception of the radiators in and against this bed or pad, which is produced by the thick layer of insulating material 6 in the space 11 and the presence of the foil layer 13, as well as the fact that the foil layer extends over the entire area of the system including the gaps 12, all heat circulation and thus heating of the space 11 as a result of hot air traveling to the same, is avoided. Thus, the electrical energy used for heating the resistance wires 10 is used optimally, i.e. very little heat is lost and most of the heat produced by the supply of electrical energy is in fact used for heating the space beneath the system. This permits, inter alia, the wiring in the space 8 to be simplified, i.e. to take fewer precautions against high temperatures, and thus to increase the reliability of the overall system.

Figure 4:
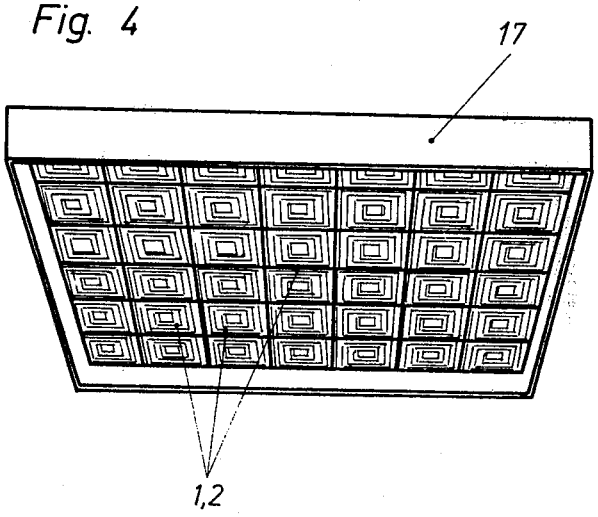
FIG. 4 is a perspective view of a system according to the present invention.

A system having 42 of the radiators 1, 2 mounted in a housing 7, is illustrated for purposes of a overview in FIG. 4; it will be seen that the surfaces 2 of the radiators 1 together form an overall composite substantially planar radiating surface.

The invention has hereinbefore been described with reference to an exemplary embodiment, both of a system and individual radia. However, it should be understood that this is not to be considered limiting in as much as various modifications may be made without in any way departing from the scope and intent of the invention. The protection sought is defined exclusively in the hereinafter appended claims.

What is claimed is:

1. An infrared radiating system, comprising a support; a plurality of hollow ceramic infrared radiators each including a front portion having a radiating element with a substantially flat radiating surface, and a rear portion mounted to said support, said front portion having also a substantially conical section and a hollow space between said conical section and said flat radiating surface; electrical conductors passing through said hollow interiors of the radiators and through said radiating element with said flat radiating surface, said conical section being joined to said radiating element with said flat radiating surface; fastening means on the rear of each radiator and fastened to said support, said fastening means being spaced from the radiating surface, and thermally insulating means rearwardly of the radiating elements and filling at least one of the spaces between said radiators and said support for preventing heat radiating backwards to said support, said thermal insulating means also filling the hollow interiors of the radiators and at least part of said hollow space between said conical section and said flat radiating surface; said support being a housing having an open side adjacent which said front portions are located, and a closed side provided with a wall on which said rear portions are mounted, said conical section comprising reflecting means for reflecting, said substantially all heat emitted by the infrared radiators forward to heat a workpiece, said reflecting means cooperating with said radiating surface so that the heat is reflected substantially uniformly of the total surface of the workpiece, the rear of the radiating system above said support remaining cool, said radiators being mounted in close proximity adjacent to one another in a common housing.

2. A system as defined in claim 1, said insulating means also filling said rear portions of said radiators.

3. A system as defined in claim 1, said radiators each including a casing having said front and rear portions, said front portions being of right-angular outline and said front portions having respective front faces which together form a substantially planar radiating surface.

4. A system as defined in claim 3, said rear portions extending rearwardly from said front portions by a distance which in conjunction with said thermally insulating means is sufficient to prevent heat from said radiators from reaching said wall.

5. A system as defined in claim 3, said front portions each having a rear surface directed towards said wall; and further comprising a thermally reflective layer on the respective rear surfaces.

6. A system as defined in claim 5, said layer being a shiny metallic foil.

7. A system as defined in claim 5, said layer being a shiny aluminum foil.

8. A system as defined in claim 5, said layer being a shiny metallic foil which extends continuously over the area bounded by said housing, closing gaps between adjacent ones of said radiators and retaining said thermally insulating means against movement towards said open side.

9. A system as defined in claim 5, said thermally insulating means and reflective layer together forming a pad through which said rear portions extend to said wall.

10. A system as defined in claim 1, adjacent ones of said radiators forming respective gaps with one another; and further comprising means covering said gaps and preventing movement of said insulating means through said gaps towards said open side.

11. An infrared radiating system, comprising a support; a plurality of hollow ceramic infrared radiators each including a front portion having a radiating element with a substantially flat radiating surface, and a rear portion mounted to said support, said front portion having also a substantially conical section and a hollow space between said conical section and said flat radiating surface; electrical conductors passing through said hollow interiors of the radiators and through said radiating element with said flat radiating surface, said conical section being joined to said radiating element with said flat radiating surface; fastening means on the rear of each radiator and fastened to said support, said fastening means being spaced from the radiating surface, and thermally insulating means rearwardly of the radiating elements and filling at least one of the spaces between said radiators and said support for preventing heat radiating backwards to said support, said thermally insulating means also filling the hollow interiors of the radiators and at least part of said hollow space between said conical section and said flat radiating surface; said support being a housing having an open side adjacent which said front portions are located, and a closed side provided with a wall on which said rear portions are mounted, said conical section comprising reflecting means for reflecting, said substantially all heat emitted by the infrared radiators forward to heat a workpiece, said reflecting means cooperating with said radiating surface so that the heat is reflected substantially uniformly of the total surface of the workpiece, the rear of the radiating system above said support remaining cool, said radiators being mounted in close proximity adjacent to one another in a common housing; said insulating means also filling said rear portions of said radiators; said radiators each including a casing having said front and rear portions, said front portions being of right-angular outline and said front portions having respective front faces which together form said substantially flat radiating surface; said rear portions extending rearwardly from said front portions by a distance which in conjunction with said thermally insulating means is sufficient to prevent heat from said radiators from reaching said wall; said front portions each having a rear surface directed towards said wall; a thermally reflective layer on the respective rear surfaces; said layer being a shiny metallic foil which extends continuously over the area bounded by said housing, closing gaps between adjacent ones of said radiators and retaining said thermally insulating means against movement towards said open side; said thermally insulating means and reflective layer forming together a pad through which said rear portions extend to said wall; adjacent ones of said radiators forming respective gaps with one another; and further comprising means covering said gaps and preventing movement of said insulating means through said gaps towards said open side.

* * * * *